US006017375A

United States Patent [19]

Duell et al.

[11] Patent Number: 6,017,375

[45] Date of Patent: Jan. 25, 2000

[54] AIR PURIFIER UNIT

[75] Inventors: Richard J. Duell; Stephen Stopyra, both of Syracuse; Theodore S. Bolton, Liverpool, all of N.Y.

[73] Assignee: Carrier Corporation, Farmington, Conn.

[21] Appl. No.: 09/017,068

[22] Filed: Feb. 2, 1998

[51] Int. Cl.[7] ..... B01D 35/30; B01D 39/14

[52] U.S. Cl. ..... 55/356; 55/357; 55/471; 55/490; 55/486; 55/497; 55/503; 55/511

[58] Field of Search ..... 55/467, 471, 473, 55/490, 495, 503, 356, 357, 497, 482, 486, 511

[56] References Cited

U.S. PATENT DOCUMENTS

| | | | |
|---|---|---|---|
| 4,011,624 | 3/1977 | Proett | 15/344 |
| 4,607,500 | 8/1986 | Bolton et al. | 62/262 |
| 5,125,239 | 6/1992 | Kobayashi et al. | 62/262 |
| 5,893,939 | 4/1999 | Rakocy et al. | 55/471 |

FOREIGN PATENT DOCUMENTS

| | | | |
|---|---|---|---|
| 59-217431 | 12/1984 | Japan | 55/495 |
| 1-168315 | 7/1989 | Japan | 55/467 |
| 4-193318 | 7/1992 | Japan | 55/467 |

*Primary Examiner*—David A. Simmons
*Assistant Examiner*—Robert A. Hopkins
*Attorney, Agent, or Firm*—Wall Marjama Belinski & Burr

[57] ABSTRACT

An air handling unit that includes a main support member and front, rear and top covers mounted on said support that forms a housing for enclosing said unit. The covers have side walls that close over the support frame in abutting contact to form an interlocking seam therebetween at closure. Ribs are mounted upon the side walls of the support frame which bias the side walls of the covers outwardly to render the seam relatively air tight at closure. Two covers are securely affixed to the main support member while the other is removably attached to the main support member by a latching means. A HEPA filter is mounted in the main support member along with a blower system for drawing air through said housing.

12 Claims, 7 Drawing Sheets

AIR PURIFIER UNIT

BACKGROUND OF THE INVENTION

This invention relates to a portable air purifier unit containing a high efficiency particle arrestor (HEPA) filter and, in particular, to a housing for an air purifier unit that has a minimum number of parts which can be brought together to provide a tight flow path through the housing which maximizes the filter's ability to remove potentially harmful contaminants from the air stream moving through the housing.

Many portable air purifiers employing HEPA filters require the use of elaborate, relatively expensive seals for rendering the flow path through the unit relatively air tight. In addition, these units are, generally bulky and thus difficult to move from place to place. The air handling equipment that is contained within the housing is sometimes mounted in such a way that the weight of the unit is unbalanced thus making lifting and carrying the unit unsafe. Similarly, many of the housings found in the prior art provide only limited access to the filter giving rise to problems when cleaning or changing the filter is necessary.

Accordingly, there is a present need for a light weight, easily portable air tight air purifying unit that affords clear and ready access to the filter contained in the unit. This need has become more pronounced as the air we breath becomes more polluted by emissions from automobiles and industrial plants. Because of the pollution in certain areas, people with respiratory problems are sometimes forced to remain indoors when the air quality drops below a safe value. Ideally, the indoor air should be further cleansed to protect the health and well being of those that suffer from respiratory problems. However, because of the cost of high efficiency air purifiers, the people most needing this type of equipment cannot afford it.

SUMMARY OF THE INVENTION

It is therefore a primary object of the present invention to improve portable air purifier units.

A further object of the present invention is to reduce the cost of high performance air purifier units without sacrificing quality.

A still further object of the present invention is to provide a housing for a portable air purifier unit that has a minimum of parts and is easy to assemble.

Another object of the present invention is to provide a housing for an air purifier that is light weight and relatively air tight.

Yet another object of the present invention is to provide a housing for a portable air purifier unit that has a removable access cover that allows for easy removal and replacement of the unit filter.

Yet a further object of the present invention is to provide a portable air purifier unit that is well balanced and thus easy and safe to lift and carry.

These and other objects of the present invention are attained by means of a housing for an air purifier unit that includes a main support member upon which the component parts of the air purifier unit are secured along with the covers that make up the outer housing. The main support member is a rectangular piece that has a top wall, a bottom wall and two opposed side walls that are integrally joined to an interior wall. Preferably, the main support member is molded of high strength plastic. A scroll is molded into the back face of the interior wall that exhausts through an opening in the top wall of the support member. A blower motor is mounted upon a bracket molded to the front face of the inner wall. The shaft of the motor passes through an orifice in the interior wall into the scroll and a fan for drawing air through the housing is attached to the shaft. An electrical bay is recessed in the top wall of the support member and contains the electrical components for the blower system. A filter assembly containing a HEPA filter is removably mounted on the front of the support member.

The present housing consists of three covers that includes a top cover, a rear cover, and a removable front access cover, all of which come together in assembly to provide a relatively air tight enclosure. The top cover is coextensive with the top wall of the support member and is secured thereto by screws. The top cover also contains an air discharge vent that is positioned over the discharge opening in the top wall of the main support member. The rear cover is similarly secured to the back of the support member by screws to close the back of the scroll and the scroll discharge opening. The front access cover is removably connected to the support member by a latching mechanism and coacts with the other two covers to enclose the housing. An air inlet vent is contained in the front access cover through which air is drawn into the housing.

BRIEF DESCRIPTION OF THE DRAWING

For a better understanding of these and other objects of the present invention, reference will be made to the detailed description of the invention which is to be read in conjunction with the following drawings, wherein.

DETAILED DESCRIPTION OF THE INVENTION

Figure 1:
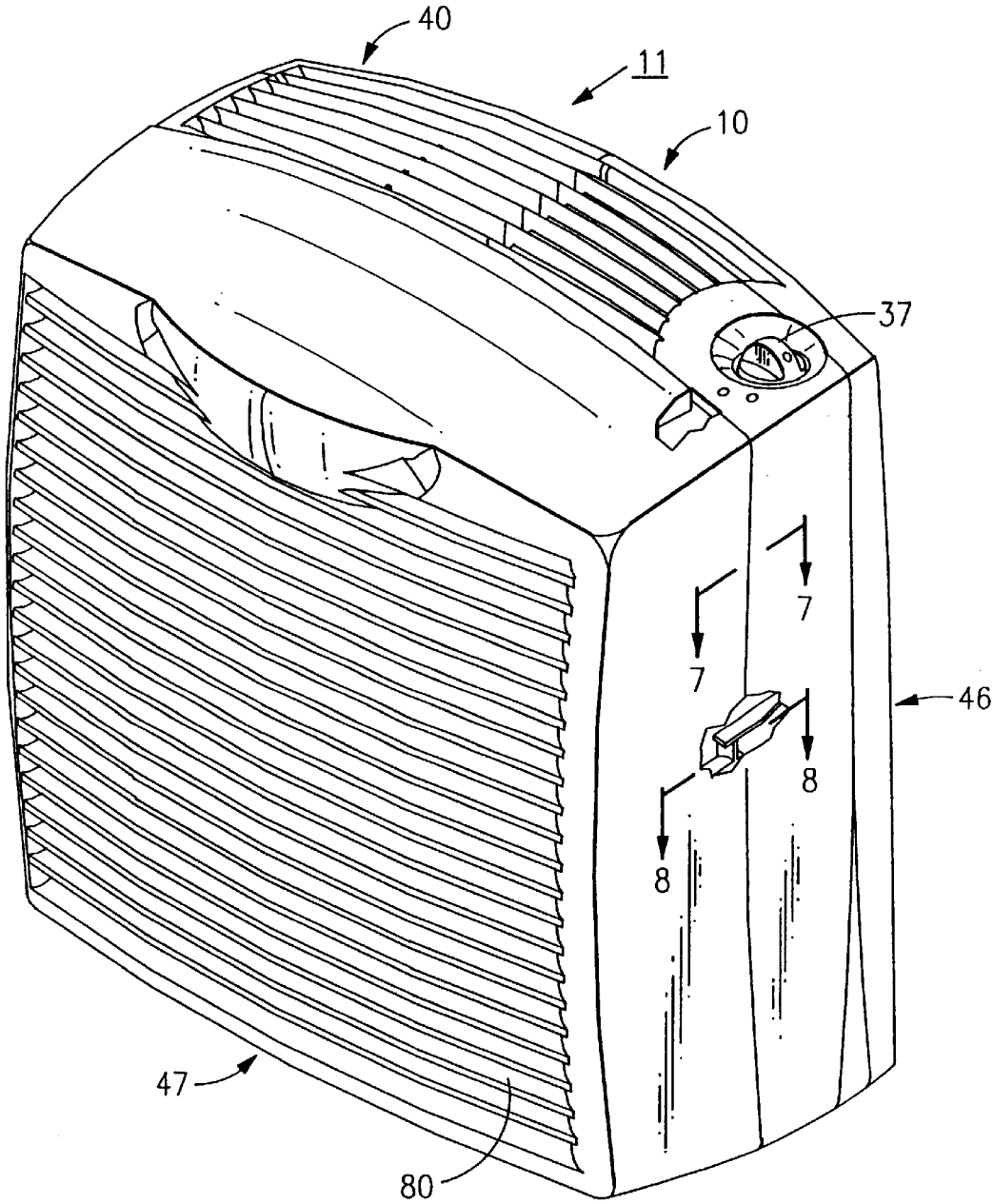
FIG. 1 is a perspective view of a portable air purifier unit embodying the teachings of the present invention.
Figure 2:
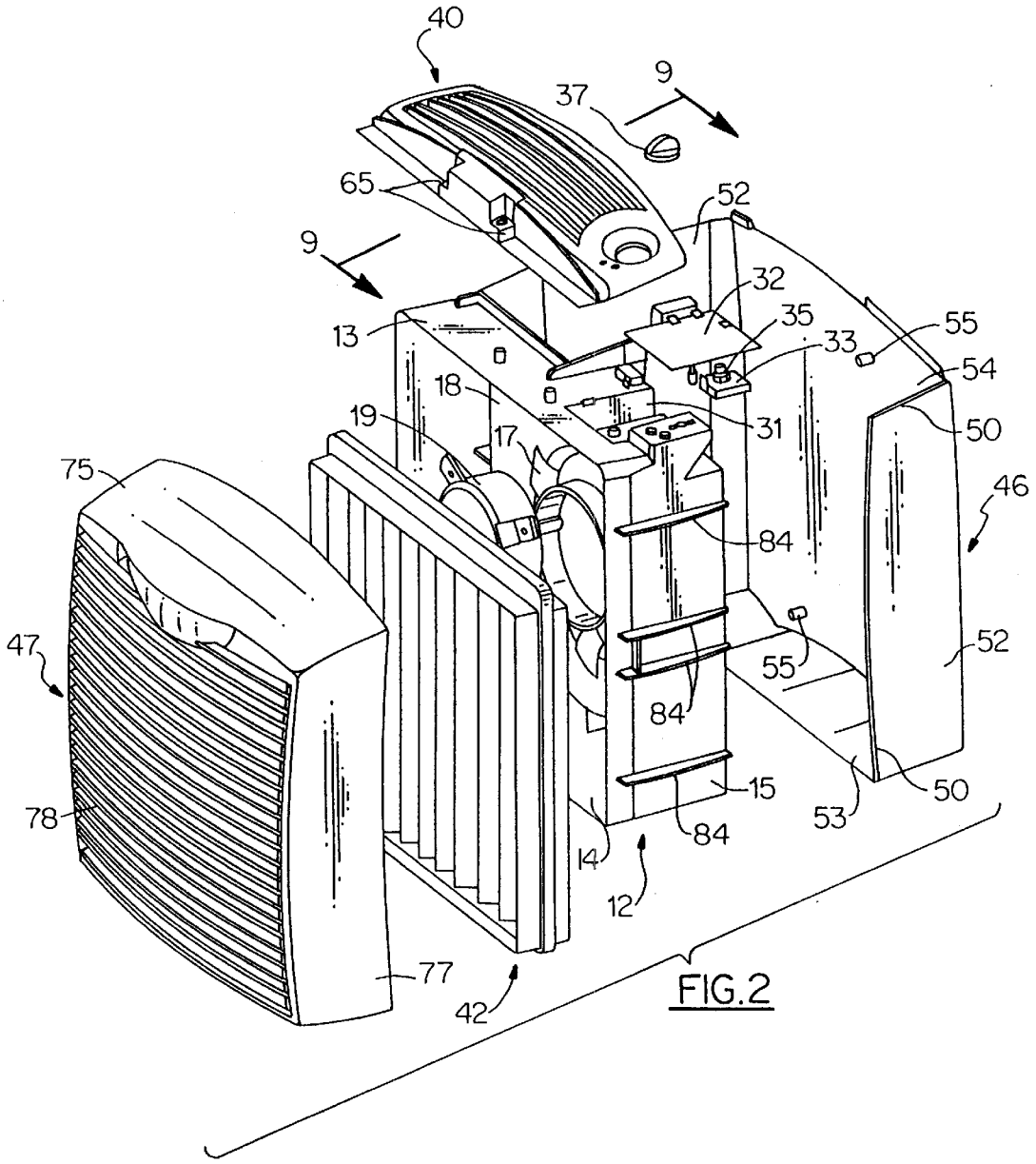
FIG. 2 is an exploded front view in perspective of the portable unit shown in FIG. 1.
Figure 3:
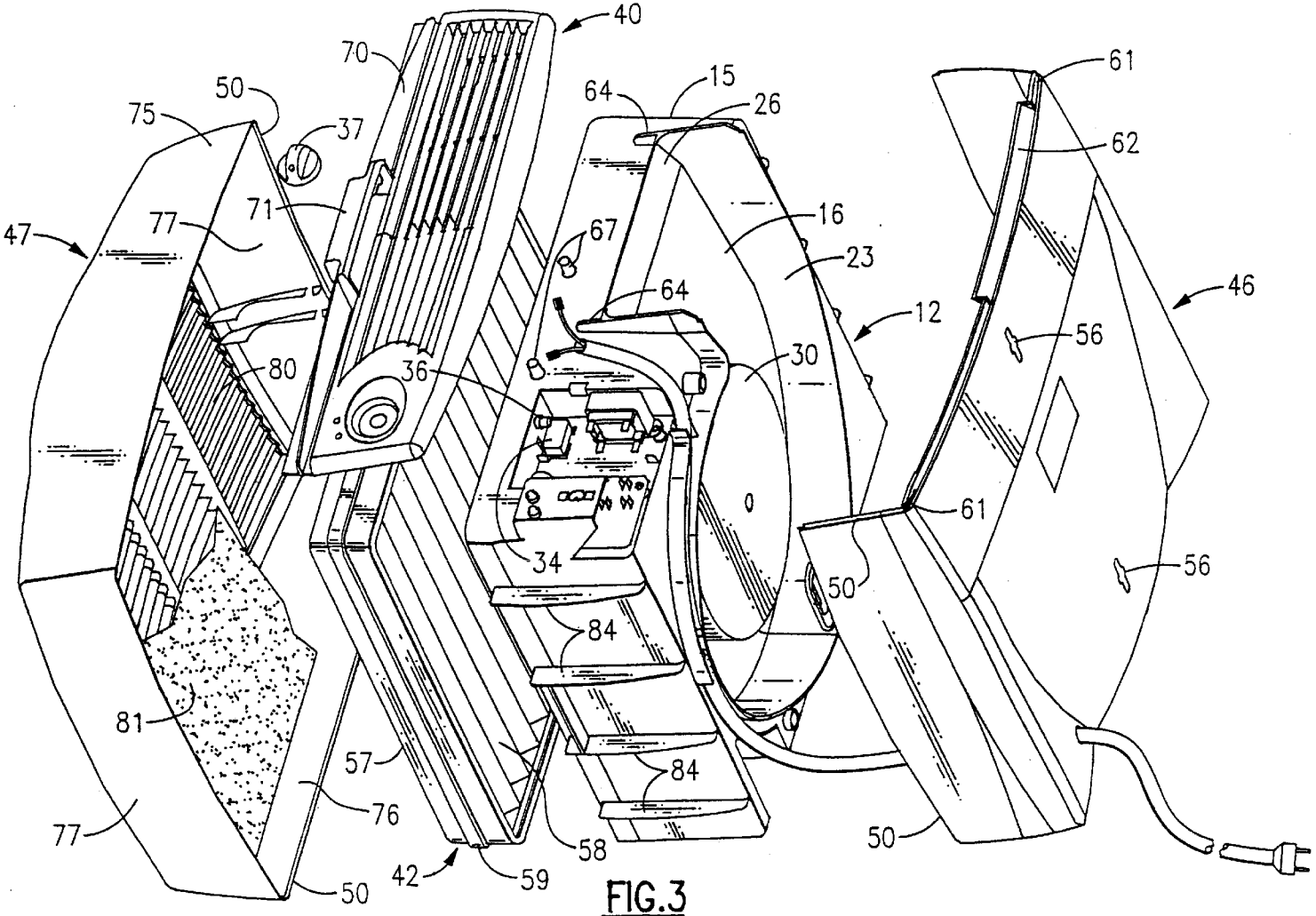
FIG. 3 is an exploded rear view in perspective of the portable unit shown in FIG. 1.

Turning initially to FIGS. 1–4, there is illustrated a housing 10 for a portable air purifier unit, generally referenced 11 that utilizes a high efficiency HEPA filter for removing fine particulate material from the air stream that is drawn through the housing. The unit contains a single main support 12 upon which all the component parts of the air purifier are mounted in a balanced condition as well as the covers for enclosing the air purification equipment. The main support is a rectangular shaped member containing a top wall 13, a bottom wall 14 and two side walls 15 that are all cojoined to an interior wall 16.

The main support is molded of a high strength plastic material. A mounting bracket 17 is molded onto the front face 18 of the interior wall, upon which a blower motor 19 is secured. A scroll 23 is molded into the back face of the interior wall that contains an orifice 24 that passes through the wall and a discharge opening 26 formed in the top wall of the housing. The blower motor shaft 27 is passed through the orifice into the scroll and a fan or impeller 30 is secured to the shaft. As will be explained in further detail below, the fan is arranged to move a flow of ambient air through the housing.

Figure 4:
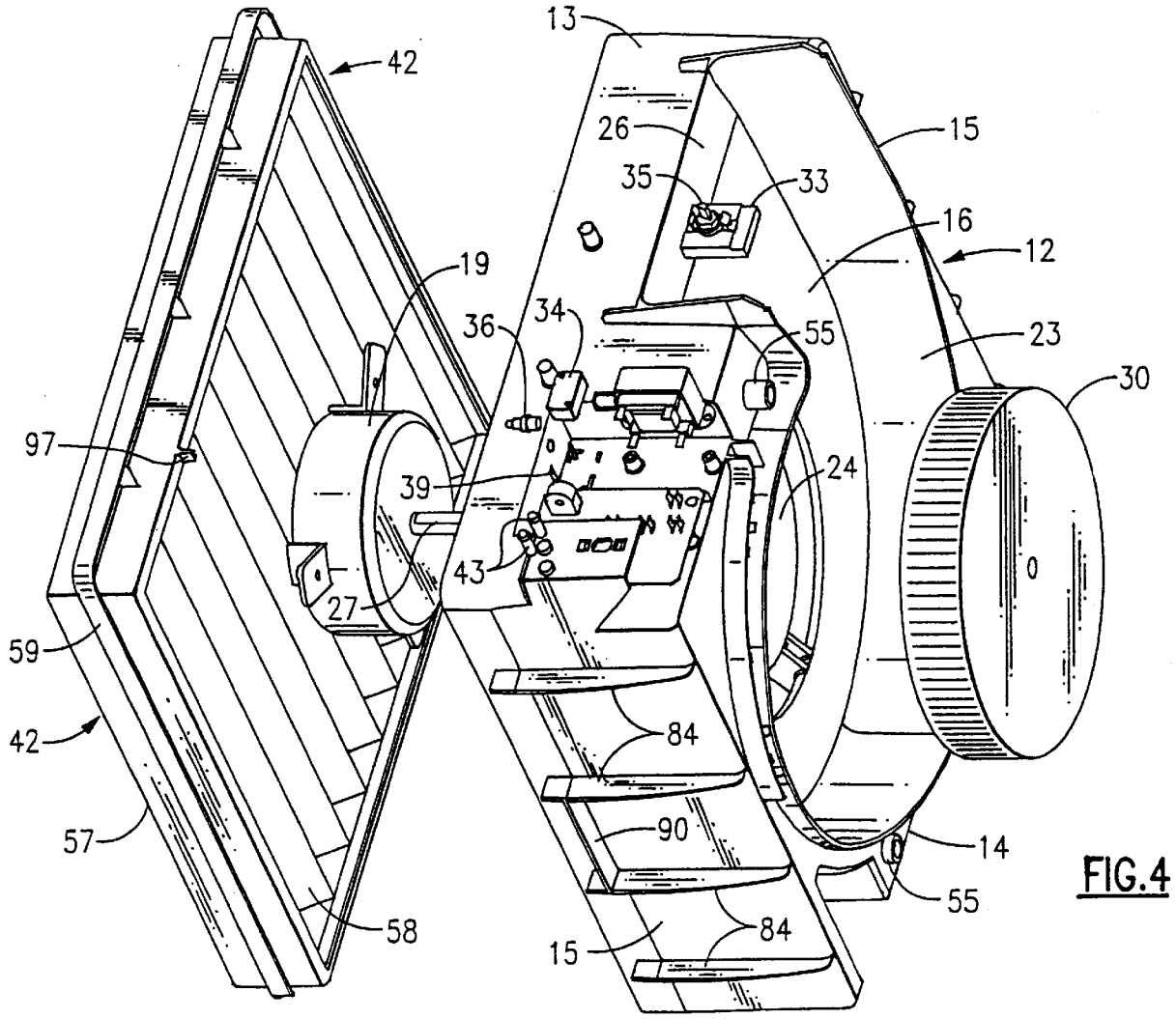
FIG. 4 is an enlarged exploded view in perspective showing the main support member of the unit and the filter assembly that is contained in the unit.

A recessed electric bay 31 is molded into the top wall of the main support adjacent to the scroll discharge opening 26. The electrical components for operating the air purification equipment are housed within the bay and includes a control board 32, a control switch 33, reset switch 36, and a safety switch 34. The control switch contains a shaft 35 that passes through the top cover 40 of the housing and a control knob 37 is mounted upon the shaft. As illustrated in FIG. 4, the safety switch is mounted behind an opening 39 in the back wall 38 of the electric bay and is adapted to sense the presence of the filter assembly 42 when the assembly is properly mounted upon the front of the main support. A pair of indicator lamps are mounted in the top wall of the support adjacent to the electric bay. The lamp bulbs, in assembly, are contained in openings 45 (FIG. 5) in the top cover 40 so that they can be clearly seen by the operator.

The housing 10 further includes a rear cover 46 and a removable front access cover 47 which combine with the top cover to enclose the main support and the air purifier equipment supported thereon. The abutting edges of the covers each contain a recess 50 and the recesses are adapted to interlock in assembly to form tight joints between the covers which serve to prevent air from passing therebetween. The front and rear covers are both molded of a resilient plastic that permits the covers to deform slightly so that the abutting edges can conform one to the other. The rear cover contains two opposed side walls 51 and 52, a bottom wall 53 and a back panel 54. The rear cover is arranged to pass over the back of the main support with the back panel closing the back of the scroll and the scroll discharge opening. Although not shown, the back cover is held to the main support by screws that are threaded into screw bosses 55 located at the back of the rear cover. Enclosed hanger compartments 56 are molded into the back panel of the rear cover for hanging the unit upon suitable wall screws.

The filter assembly 42 includes a frame 57 that contains a HEPA filter 58 that is sealed to the inside wall surfaces of the frame. An L-shaped mounting flange 59 surrounds the outer periphery of the frame and is arranged to close against the front edges of the main support outer walls, thus removably securing the filter assembly to the front of the support frame at the entrance to the blower system. The filter frame forms an air-tight joint with the outer edge surfaces of the main support so that air can be effectively drawn through the filter with little or no leakage.

Figure 9:
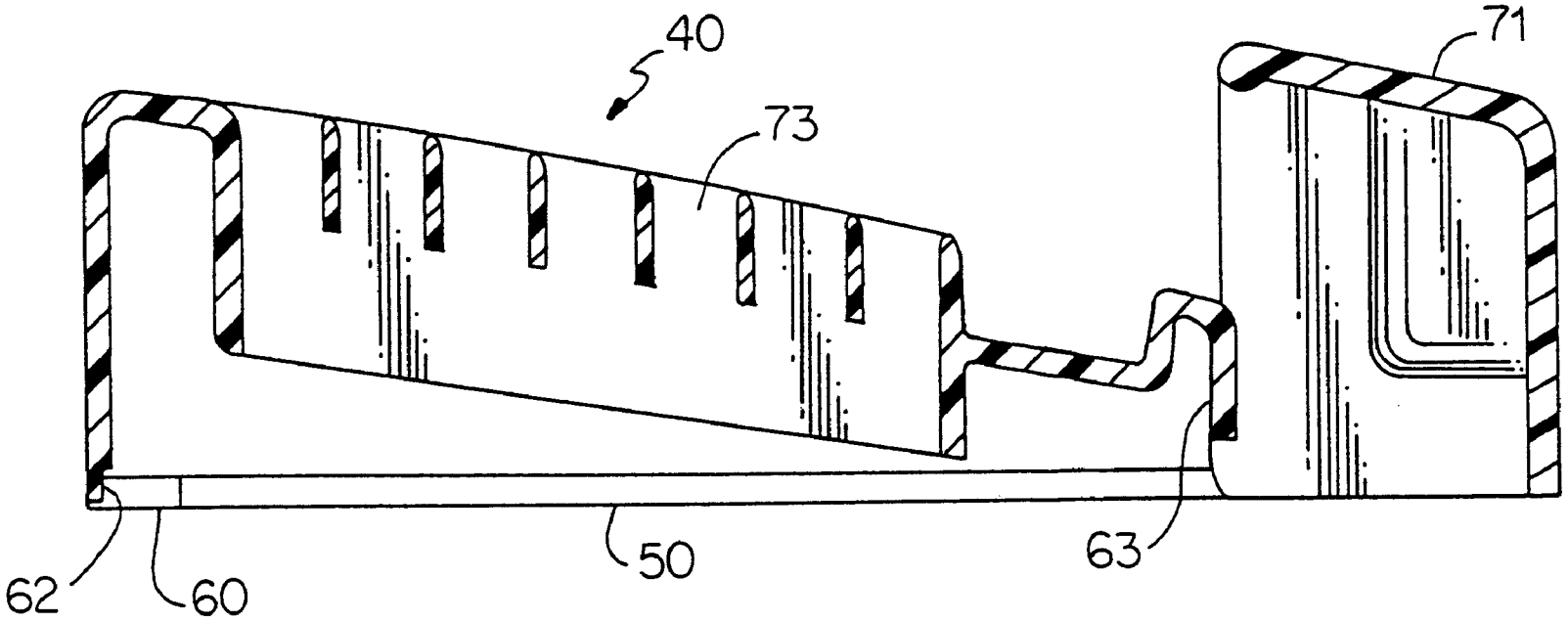
FIG. 9 is an enlarged sectional view taken along lines 9—9 in FIG. 2 showing the construction of the top cover.

The top cover 40 of the housing has a pair of ears 62 at the two inside back comers of the cover (FIG. 9). The ears are arranged in assembly to lock into channels 61 formed along the top edge of the back panel of the rear cover. A lateral inner wall 63 is further located in assembly in front of raised tabs 64 on the top wall of the main support and in front of the raised platform section of control area which prevents the top cover from moving rearwardly when it is closed against the top wall of the support. A pair of screws, not shown, are passed downwardly through pads 65—65 and are threaded into raised screw bosses 67 molded in the main support's top wall to securely hold the top cover to the support. As noted above, recesses are provided along the abutting edges of the covers to form a tight joint therebetween. A raised partition 70 passes laterally across the top of the top cover. An open sided handle grip 71 is centrally mounted in the partition which allows the unit to be firmly grasped and lifted. The grip is located so that the weight of the main support and the blower assembly is well balanced about the grip further facilitating easy and safe lifting and carrying of the unit. An air exhaust vent 73 is contained in the top cover which, in assembly, is positioned over the scroll discharge opening through which clean air is exhausted from the unit.

The front access cover 47, like the rear cover, is molded from a resilient plastic. The front cover contains a top wall 75, a bottom wall 76, and a front panel 78. The front panel contains an air inlet vent 80 through which air is drawn into the housing. A secondary filter 81 is mounted inside the access cover behind the air inlet vent which serves to precondition air being drawn into the unit prior to its being treated by the HEPA filter. The leading front edges of all the cover walls are provided with an inner recess which is arranged to mate in assembly with surfaces on the other covers to form tight seams between the covers.

Figure 6:
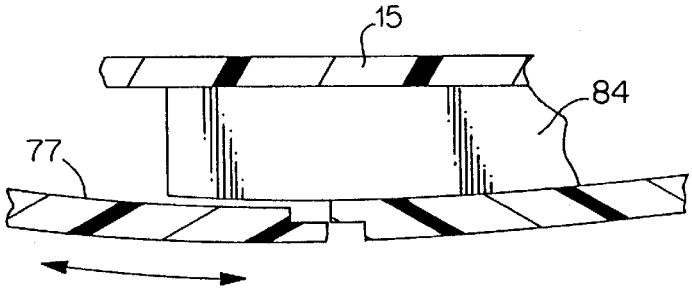
FIG. 6 is a partial view in section showing one of the interlocking cover flanges in an open position.
Figure 7:
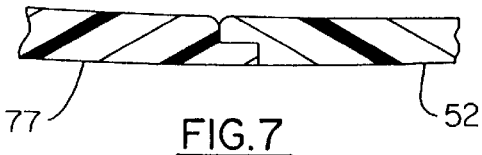
FIG. 7 is a partial view in section showing the interlocking cover flange illustrated in FIG. 6 in a closed position.

A series of horizontally disposed ribs 84 are mounted upon the outside of the side walls of the main support. The top surface of each rib is contoured so that it inclines both toward the front and the back of the support. The inclined surfaces are arranged to position the side walls of the front and back covers so that the abutting edges of the covers come into interlocking relationship as shown in FIGS. 6 and 7 to form a tight seam therebetween. The ribs are designed to urge the side walls of the front and rear covers outwardly at closure to deform the covers slightly thus placing all the walls of the covers in tension. This tightens the seams between the covers and prevents the covers from rattling when the blower is in operation.

Figure 5:
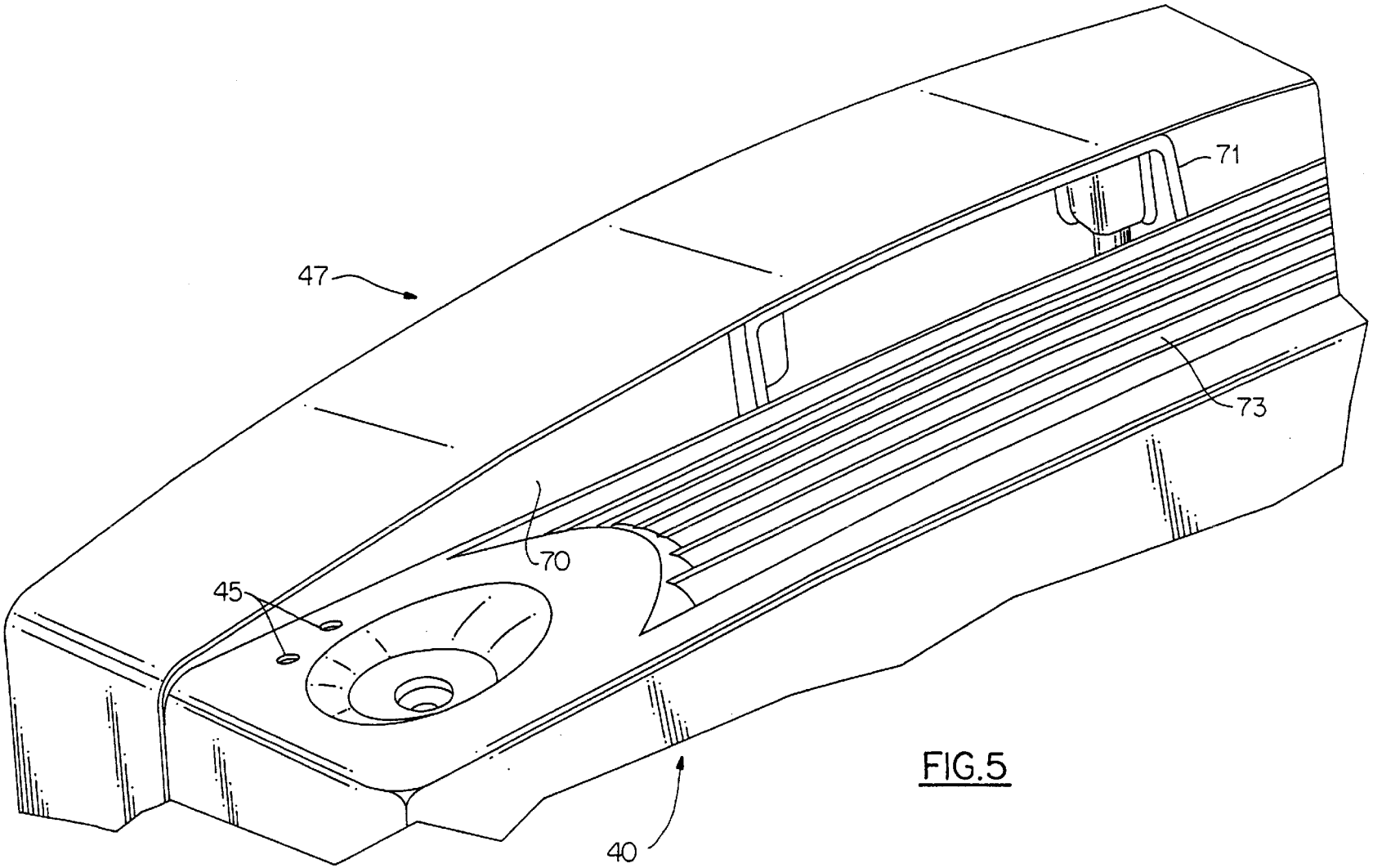
FIG. 5 is a partial view in perspective of the top section of the unit more clearly showing the top cover of the unit housing.

As illustrated in FIG. 5, the top wall 75 of the front access cover is adapted to pass over the top of the partition 70 in the top cover and provide an interference fit therewith at closure. The front access cover thus shields the handle 71 on three sides to enhance the aesthetic value of the housing while still providing ready access to the handle.

Figure 8:
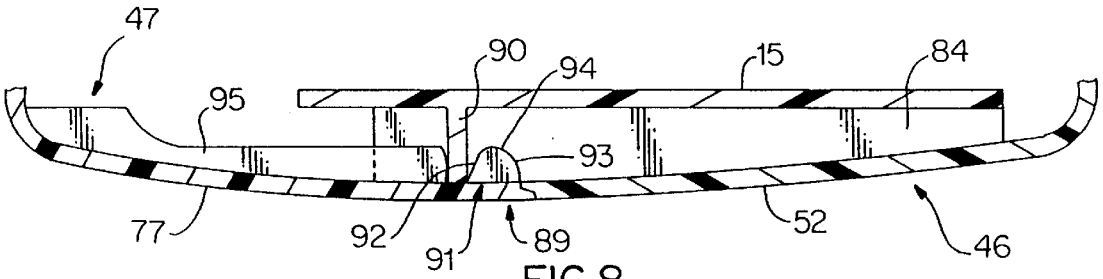
FIG. 8 is a partial view in section showing one of the latching mechanisms for removably securing the front access cover to the main support member of the unit.

Referring now to FIG. 8, a latching mechanism 89 is furnished for removably securing the front access cover 47 to the main support 12 of the unit. The latching mechanism includes a vertically disposed latching bar 90 mounted upon the outside of each side wall of the main support and a pair of latching ears 91 mounted upon the inside of each side wall of the access cover. The latching ears have inclined front and rear surfaces 92 and 93 that are cojoined by an arcuate shaped top surface 94. Accordingly, when the front access cover is being closed over the main support, the side walls of the cover are biased outwardly by the ribs 84 and the latching ears ride up over the latching bars. At closure the ears snap over the bars and the walls of the access cover drop back into interlocking contact with the other covers. A stop 95 is mounted on the inside of the front access cover side walls behind each latching ear to prevent the cover from moving any further over the main support once the cover reaches the desired closed position. Although not shown, stop ribs are also mounted on the inside of the front access cover that are arranged to come into contact with the main support member to help locate the cover in the desired closed position Turning back to FIG. 4, a tab 97 is mounted upon the filter frame 42 which protrudes outwardly from the frame. The tab is arranged to move into hole 39 in the main support and close the safety switch 34 when the filter assembly is properly mounted upon the main support. This, in turn, provides power to the blower motor and the control circuitry of the blower system. As can be seen, the front access cover of the housing, when removed from the support frame, provides unlimited access to the filter assembly. Accordingly, the filter assembly can be easily removed and installed in the unit when the filter requires cleaning or replacing.

While this invention has been explained with reference to the structure disclosed herein, it is not confined to the details set forth and this invention is intended to cover any modifications and changes as may come within the scope of the following claims.

What is claimed is:

1. A portable air purifier unit that includes:

a rectangular main support member having a top wall, a bottom wall, two opposed side walls and an internal wall attached to said other walls;

said internal wall having front and back faces and an orifice passing through said internal wall;

a scroll located on the back face of the internal wall having a discharge opening that passes through the top wall of the main support member and a mounting bracket on the front face of the internal wall;

a blower motor secured to said bracket having a shaft that passes through the orifice into said scroll;

cover means mounted on said main support member for completely enclosing said support member, said cover means includes a top cover and a rear cover that are secured to the main support member and a front access cover removably attached to said main support member, said front and rear covers having abutting side edges containing interlocking means for forming seams for completely enclosing the side walls of the support member, said cover means further providing a substantially air tight enclosure for said unit; and a primary filter means removably mounted on the front of said main support member.

2. The air purifier unit of claim 1 that further includes contoured ribs on the outside of the side walls of said main support member for biasing side walls on said front and rear covers outwardly to tightly close said seams.

3. The air purifier unit of claim 1 that further includes latching means operable between the front access cover and the main support member for removably supporting the access cover to said main support member.

4. The air purifier unit of claim 3 wherein the latching means includes a latching bar mounted on the outside of the opposed side walls of said main support member and latching ears and stops mounted upon the inside of the opposed side walls of said front access cover that are arranged such that said latching bars are disposed between said latching ears and said stops.

5. A portable air purifier unit that includes a rectangular main support member having top, bottom and side walls and an internal wall that is integral with said other walls, a scroll located on the back face of said internal wall that communicates with a discharge opening in the top wall of the main support member, a rear cover having a bottom wall, a pair of side walls and a back panel, said back panel arranged to close the back of the scroll and the back of the discharge opening, means for securing the rear cover to the support so that the bottom and side walls of the rear cover partially encompass the back portion of the main support member, a top cover secured to the top wall of the main support member in abutting contact with the back panel and side walls of the rear cover, said top cover having a discharge vent positioned over the discharge opening in the support frame and a raised partition extending across the front of said top cover, a removable front access cover having top, bottom and side walls that are integral with a front panel and containing an air inlet vent, the walls of the front cover encompassing the front portion of the main support member and the raised partition on the top cover, the side walls and bottom wall of the front cover in abutting contact with similar walls on the rear cover and the top wall of the front cover in abutting contact with the raised partition on the top cover, thereby completely enclosing the main support member;

a latching means operable between the side walls of the main support member and the front cover for removably securing the front cover to the main support member, a motor means mounted on the front face of the internal wall of the main support member having a shaft passing through an orifice in said internal wall into said scroll, and a fan mounted upon said shaft within the scroll to draw air through said inlet vent and exhaust the air through the discharge vent; and at least one filter means mounted inside the front cover for filtering air passing through said front cover.

6. The air handling unit of claim 5 that further includes interlocking means extending along the abutting edges of the covers that coact to form tight joint between the covers.

7. The air handling unit of claim 5 that further includes the ribs mounted upon the outside of the side walls of the main support member for engaging side walls on the front and rear covers and urging the side walls of the front and rear cover outwardly to tighten the joint between the interlocked cover walls.

8. The air handling unit of claim 5 that further includes a filter frame that is slidably received in the front of the support, a HEPA filter pack mounted within said frame, and an air tight joint formed between the filter pack and the filter frame.

9. The housing of claim 8 wherein said filter frame has a flange encircling its outer periphery, said flange being arranged to receive the front edge of the main support member therein.

10. The housing of claim 8 that further includes a secondary filter mounted in said front access cover behind the inlet vent.

11. The housing of claim 5 wherein said latching means include ribs mounted on the outside of each side wall of the main support member and coacting beveled latching ears mounted on the inside of the side walls of the front cover that are arranged to snap over the latching ribs to removably attach the front cover to the main support member.

12. The housing of claim 5 wherein said raised partition in the top cover has a recessed handle centrally located beneath the top wall of the front access cover that opens to the rear of said partition.

* * * * *